US007287348B2

(12) United States Patent
Harkins

(10) Patent No.: US 7,287,348 B2
(45) Date of Patent: Oct. 30, 2007

(54) INFORMATION DISPLAY WITH INSERTABLE TYPED OR PRINTED INFORMATION STRIPS

(75) Inventor: Rand Harkins, Lake Bluff, IL (US)

(73) Assignee: Nelson-Harkins Industries, Inc., Chicago, IL (US)

( * ) Notice: Subject to any disclaimer, the term of this patent is extended or adjusted under 35 U.S.C. 154(b) by 275 days.

(21) Appl. No.: 11/131,061

(22) Filed: May 17, 2005

(65) Prior Publication Data

US 2006/0260167 A1 Nov. 23, 2006

(51) Int. Cl.
*G09F 7/00* (2006.01)

(52) U.S. Cl. ..... 40/585; 40/618; 40/611.06; 40/611.07

(58) Field of Classification Search ..... 40/585, 40/374, 490, 611.06–661.1
See application file for complete search history.

(56) References Cited

U.S. PATENT DOCUMENTS 1,377,812 A * 5/1921 Dlugach ..... 40/586
1,462,822 A * 7/1923 Rand ..... 40/374
1,658,937 A * 2/1928 Nelson ..... 40/585
2,732,822 A * 1/1956 Cassady et al. ..... 116/324
2,795,205 A * 6/1957 Wells ..... 116/324
3,838,529 A * 10/1974 Aybar ..... 40/585
5,161,827 A * 11/1992 Grosso ..... 283/77
5,343,646 A 9/1994 Cobb et al.
5,481,816 A 1/1996 Cobb et al.
6,148,556 A * 11/2000 Seki ..... 40/661
6,298,592 B1 * 10/2001 Baier ..... 40/611.07
6,421,940 B1 7/2002 Cobb et al.
7,207,129 B2 * 4/2007 Buchanan et al. ..... 40/611.06

OTHER PUBLICATIONS

Nelson-Harkins Directories Bulletin Boards Display Systems—Catalog 150D pp. 1-43.
Visulex[40] Express Enclosed Directory—APCO-.
APCO Signs: Visulex Copyright © 2004 APCO Graphics, Inc. Dec. 30, 2004.

* cited by examiner

*Primary Examiner*—William L. Miller
(74) *Attorney, Agent, or Firm*—Schiff Hardin LLP

(57) ABSTRACT

In a method and system for displaying information on a display mount, at least one one-piece information strip holder is provided having a clear window and first and second parallel channels for receiving a respective information strip. Information is entered onto the information strip. The information strip is slid into the first and second parallel channels of the at least one information strip holder. The information strip holder is mounted to the display mount.

10 Claims, 2 Drawing Sheets

*FIG. 1*

INFORMATION DISPLAY WITH INSERTABLE TYPED OR PRINTED INFORMATION STRIPS

BACKGROUND

It is known to provide a display system, such as a directory of names in the lobby of a building, for example, having a plurality of film strips with indicia thereon, such as names and room locations. These indicia are photographically developed on the filmstrip. A back lighting may then shine through the strip. It is also known to provide strips such as plastic opaque strips, which are engraved. Both the film strips or the engraved strips are retained in a frame assembly typically having a back plate and side channels which receive and retain the strips with indicia information thereon. The strips are typically stacked vertically and resting on top of another in the frame assembly.

A disadvantage of the above-mentioned systems is that placement of the indicia on the strip is typically done either photographically or by engraving. Thus, the customer for the information display must typically order from the company which sold him the information display new or additional strips having the appropriate information photographically developed or engraved thereon. Thus, expense and delay are involved in obtaining new strips with new indicia thereon.

It is also known to use a typewriter or printer, such as a laser printer for example, to place information indicia onto paper. However, heretofore, systems for displaying the typed or printed indicia on paper strips in a frame system have been complicated and expensive.

SUMMARY

It is an object to provide an information display system for receiving information strips which is convenient and simple to use and manufacture.

In a method and system for displaying information, a display mount is provided which receives at least one or more one-piece information strip holders having a clear window and first and second parallel channels for receiving a respective information strip. Information is entered onto the information strips. The information strips are slid into the first and second parallel channels of at least one or more of the information strip holders.

DESCRIPTION OF THE PREFERRED EMBODIMENT

Figure 1:
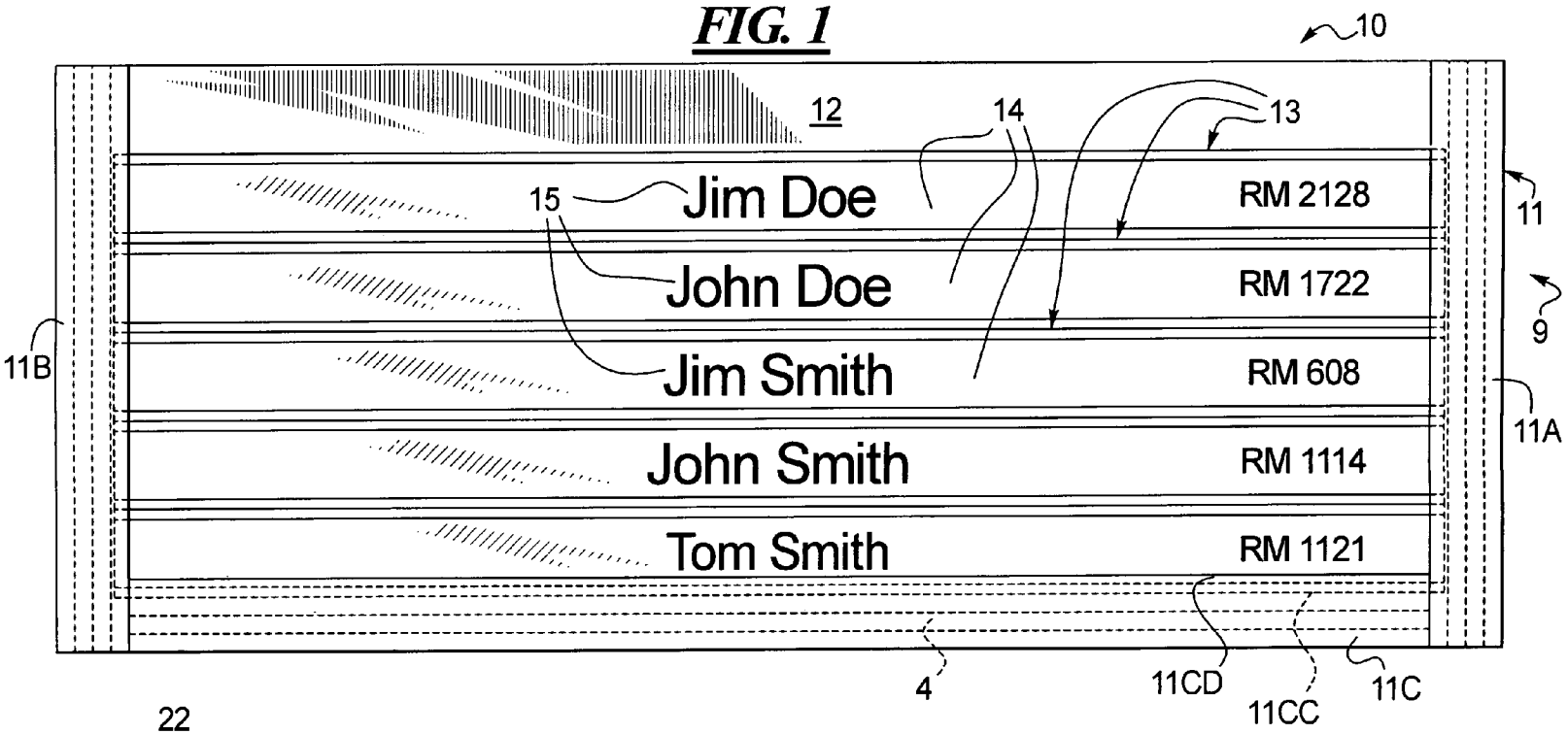
FIG. 1 is a front view of an information display system employing printed or typed information strips.

For the purposes of promoting an understanding of the principles of the invention, reference will now be made to the preferred embodiment illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

An information display system 10 is shown in a front view in FIG. 1. In the preferred embodiment, this is a directory such as in the lobby of a building containing information such as the names of personnel in the building including their room location information, for example. Alternatively, the information may be a directory of offices and their room location. Although in this preferred embodiment, a building directory is shown as exemplary of the information display system, the present disclosure is not so limited and may relate to other types of information display systems besides building directories.

The information display system 10 comprises a display mount such as a display panel comprising a frame assembly 9 formed of a frame 11 and a back plate 12. The frame 11 may comprise right and left side frame side pieces 11A, 11B and a frame bottom piece 11C.

The frame 11 together with the back plate 12 provides left and right side channels 16A, 16B (FIG. 2) for receiving a plurality of flexible information strip holders 13. These information strip holders 13 may be inserted from the top, or may be bowed or flexed so that they may be inserted from the front of the display system.

The strip holders 13 are vertically stacked in the channels 16A, 16B, with their side edges abutting against one another as shown in FIG. 1.

The information strip holders 13 receive a respective flexible information strip 14 having printed or typed information indicia thereon. As previously indicated this information indicia may be names of people residing in the building and their room location, for example.

Figure 5:
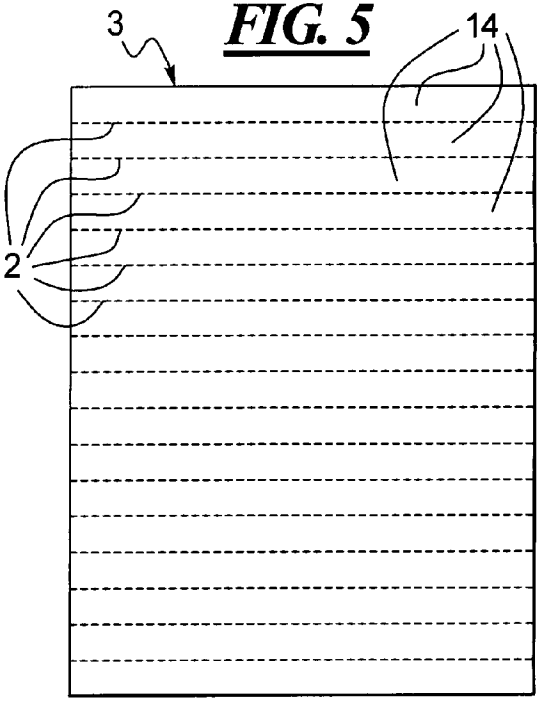
FIG. 5 is a front view of a sheet from which the information strips are separated.

As shown in FIG. 5, preferably the individual information strips 14 are separated from a paper sheet 3 where the sheets can be cut or perforated along lines 2 for separation into the individual paper strips. The information indicia is printed or typed such as by use of a typewriter, laser printer, or other type of printing machine typically available to the user of the display system. The user of the display system may then conveniently create new and/or additional paper information strips with appropriate desired information indicia thereon from time to time at their convenience without the need to order the strips from another source, such as the seller of the information display system. This then saves both time and money and is much more convenient than having to order strips which are photographically developed to create the information thereon, or where engraving is required to provide the information on the strip.

Although paper strips are preferred, it is envisioned that other materials which can be conveniently printed or typed on at a user's location may be employed, such as a thin film sheet which is compatible with a typewriter, laser printer, or other type of printer at the user's location.

Now again referring to FIG. 1, additional details of the frame 11 will be described. The bottom-most information strip holder rests inside a bottom channel 11CC of the frame bottom piece 11C. The other strips are then stacked and rest above one another in the display system frame assembly 11. The frame bottom piece 11C has a lip 11CD forming the bottom channel 11CC together with the back plate 12 for receiving the bottom most strip holder 13.

Figure 2:
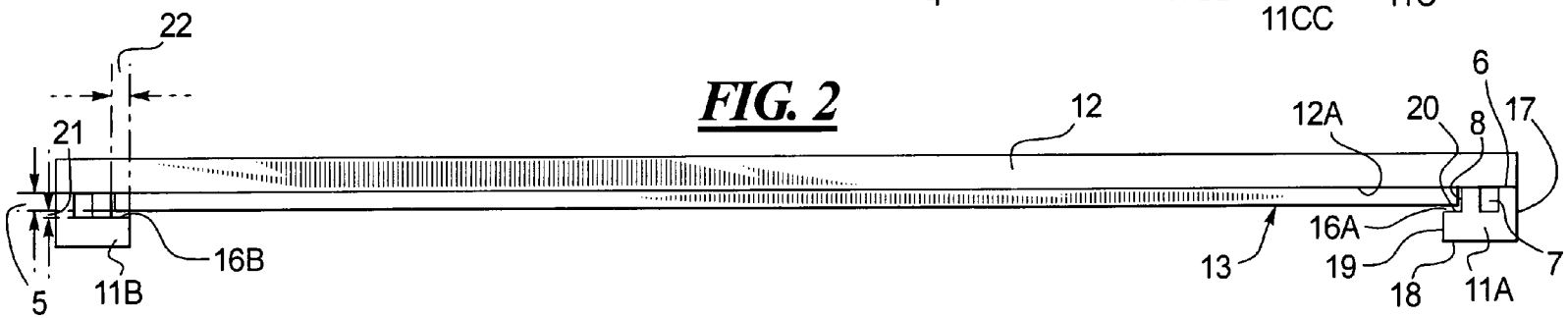
FIG. 2 is a top view of FIG. 1.

In the top view illustrated in FIG. 2, the frame right side piece 11A forms the channel 16A together with the back panel 12. The frame sidepiece 11A has a side portion 17, a front portion 18, an inner side portion 19, an overhang surface portion 20, and an abutment portion 8. The abutment portion 8, overhang portion 20, and the adjacent front surface 12A of the back plate 12 form the channel 16A.

A notch 7 is formed in the mounting surface 6 of the frame sidepiece 11A. The notch 7 ensures a constant width of the mounting surface 6 when the frame sidepiece 11A is extruded. The frame bottom piece 11C also has a notch 4 (see FIG. 1) similar to the notch 7 in frame sidepieces 11A and 11B.

The frame side piece 11A may be glued at the side of the front surface 12A of the back plate 12. Of course the frame side piece also could be integral with the back plate 12 or may be attached in other ways.

As shown in FIG. 2, if the information strip holder 13 is lying against the front surface 12A of the back plate 12, then there is a front clearance gap shown at 21. This clearance gap is sufficient to allow easy insertion and removal of the strip holders and sliding of the holders along the respective right and left channels 16A, 16B. If the gap 21 is too large, the strips may not meet for an abutment in the vertical direction, but could accidentally overlap and slide past each other. Thus the gap 21 should preferably be less than a thickness 5 of the strip holders themselves.

The back plate and frame is preferably formed of acrylic, such as by injection molding. However, other materials may be used such as metal or other types of plastic.

The overhang distance 22 in the channel 16A or 16B is sufficient to provide a firm engagement of the ends of the strip holders but without overlapping onto portions of the information strip which may contain information.

Figure 3:
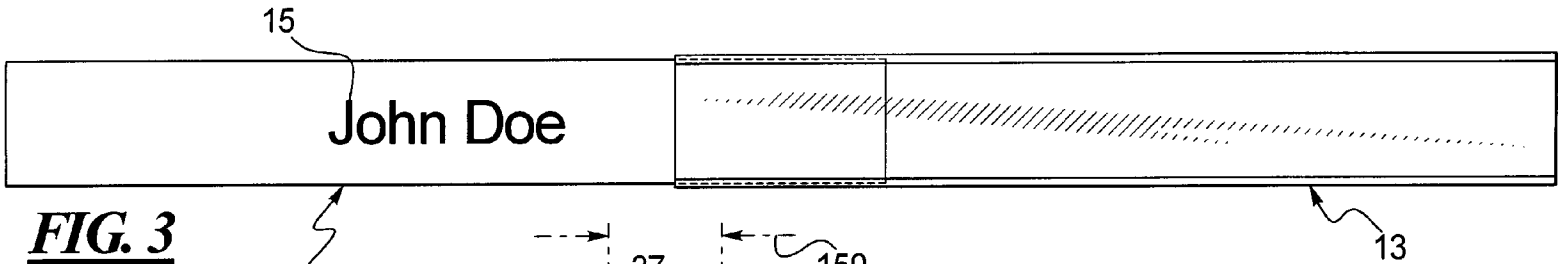
FIG. 3 is a front view of an information strip holder showing insertion of an information strip into the holder.

As shown in FIG. 3, the flexible information strip 14 with the indicia 15 thereon is slipped into the strip holder 13. This also can be seen in FIG. 4, which shows an end view the strip holder 13 with the inserted strip 14.

Figure 4:
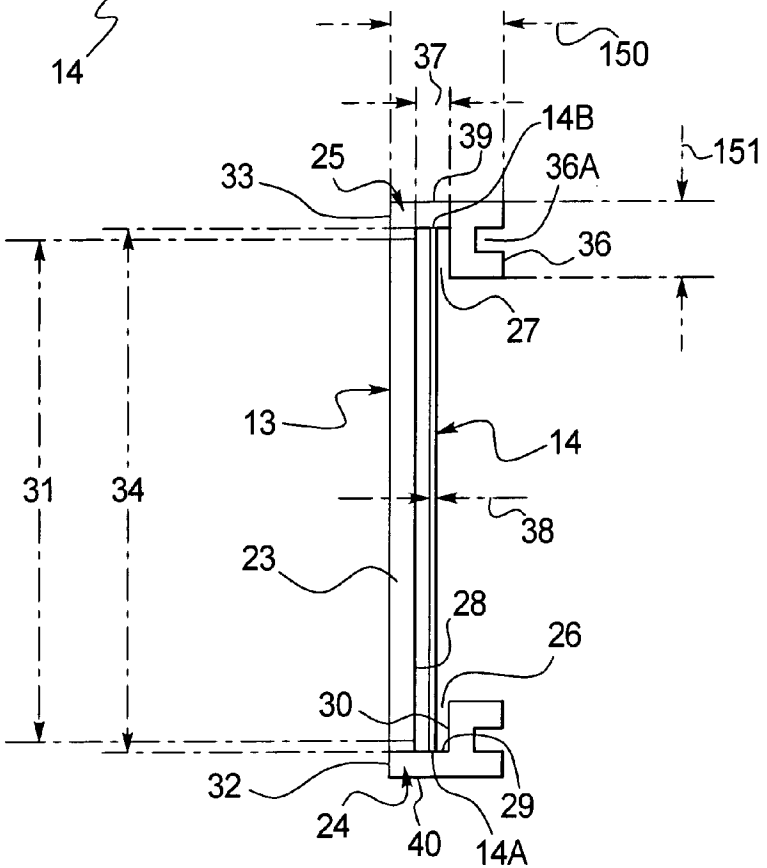
FIG. 4 is an end view of the information strip holder with the inserted information strip of FIG. 3.

As shown in FIG. 4, the strip holder is preferably formed of plastic and has a clear window 23 and opaque bottom and top members 24, 25. The bottom and top members provide a preferably white opaque edge stripe at a bottom and top of the clear window to provide a striking visual effect when the white information strip is inserted since these white opaque stripes conceal bottom and top edges of the information strip 14. It is also possible in another embodiment that the bottom and top members 24, 25 may be clear.

The bottom and top members 24, 25 form respective channels 26, 27. For example, channel 26 is formed by parallel walls 28, 30 and abutting wall 29.

Advantageously, as shown in FIGS. 3 and 4, the information strip holder 13 is formed of a single integral piece of material during an extrusion process. The clear window 23 and bottom and top members 24 and 25 which may be opaque are formed during the same extrusion process but with a colorant being added to form the opaque members 24 and 25.

Preferably the clear window 23 has a width dimension 31 between the opaque outwardly facing surfaces 32, 33 of the opaque members 24 and 25 which is less than a width 34 between the bottom and top edges 14A, 14B of the information strip 14. Thus, the bottom and top longitudinal edges 14A, 14B of the strip 14 are hidden by the overlapping opaque surfaces 32, 33 of the bottom and top members 24, 25 to give a "clean" look or appearance to the strip holder 13 when it is containing a strip 14.

The bottom and top members 24 and 25 have a thickness 150 in a direction perpendicular to the clear window surface 23 which is preferably about ⅛ inch, but lies preferably in a range less than a ¼ inch and greater than 1/16 inch. If this thickness is too great, than the strip holder is not sufficiently flexible for insertion into the display system. If it is too little, then the strip is too flimsy and will not hold its shape and may break.

The bottom and top members 24 and 25 have a mounting surface 36 with a notch 36A. The notch ensures that during extrusion formation of the top and bottom members, the width 151 of the mounting surface 36 remains substantially constant.

The width 37 of the channel 26 or 27 is selected to be approximately five times the width 38 of the information strip 14. This thus allows convenient slipping of the strip 14 into the strip holder and retention thereof during handling of the strip holder. This channel width 37 may vary in a range from approximately two times to ten times the strip width 38.

Preferably, the front surfaces 32, 23, and 33 of the strip holder are all lying in the same plane and the top and bottom abutment surfaces 39, 40 of the strip holder 13 are perpendicular to the surfaces 32, 23, and 33. Thus, the strip holders can conveniently rest on top of each other when mounted in the display system.

Thus with the preferred embodiment of the display system described, the user of the display system can conveniently add, change, and/or replace the information strips and freely change the information thereof by use of the user's own printing equipment such as a small laser printer, typewriter, or relatively other convenient inexpensive printing system which the user of the display system would typically have available on the premises.

With respect to the described preferred embodiment, the information strips are conveniently held in a one-piece strip holder, which is conveniently received in a simple frame assembly. Also, the strip holders containing the strips can be easily mounted either by sliding in from the top of the display system or can be flexed for insertion from the front, such as when the display system is vertically mounted.

A unique feature of the information strip holder is that it is of one-piece construction and thus does not require two separate pieces to capture and hold the inserted information strip 14. This results in a strip holder with inserted information strip which is easier for the user and more cost efficient.

Another important related feature of the one-piece information strip holder is that the bottom and top opaque members 24, 25 preferably comprise white stripes lying at opposite sides of the very clear window at the center, thus allowing an excellent "see-through visibility" of the indicia on the white information strip inserted into the strip holder. Opposite edges of the white paper information strip are thus concealed by the opaque white bottom and top stripes of the extruded strip holder 13.

Although in the drawings and in the preceding description a preferred embodiment has been illustrated and described in every detail, this is to be considered as being merely exemplary and as not restricting the invention. It is pointed out that only the preferred embodiment has been illustrated and described and all variations and modifications which are within the scope of the invention at present or in the future are protected.

I claim as my invention:

1. A display system, comprising:

a display mount;

at least one information strip holder retained on said display mount;

said information strip holder being a one-piece unit formed of a top and bottom member with a clear front window therebetween, said information strip holder having an open back behind the front window, and first and second opposing parallel channels each defined by a respective rear surface portion of said front window, a parallel back wall of respective said top and bottom members, and a flat wall of respective said top and bottom members perpendicular to said rear surface portion and back wall, said top and bottom members providing an opaque stripe at each opposite side of the clear window for receiving a respective information strip; and said information strip comprising printed or typed information thereon and received in said first and second parallel channels with the information being viewable through said clear window, and opposite edges of said information strip being concealed by said opaque stripes.

2. A system of claim 1 wherein the information strip comprises paper.

3. A system of claim 1 wherein the information on the information strip comprises laser or ink-jet printed characters.

4. A system of claim 1 wherein the display mount comprises a building directory, a plurality of the strip holders are provided, and the information on the respective information strips comprises names and locations of persons in the building.

5. A system of claim 1 wherein said display mount comprises a panel having a back plate with opposed parallel side channels extending vertically along opposite side edges of said back plate, and wherein a plurality of said information strip holders are retained at said back plate by said side channels, said information strip holders lying stacked above each other in the side channels.

6. A system of claim 1 wherein the bottom and top members providing the respective opaque stripes with the clear window in between are opaque and wherein a distance between the opaque stripes of the respective bottom and top members is less than a width of the strip so that a portion of the bottom and top opaque stripes covers a top and bottom edge of the respective strip.

7. A display system, comprising:

a display mount;

at least one information strip holder retained on said display mount;

said information strip holder being a one-piece unit formed of a clear window and first and second opposing parallel channels providing an opaque stripe at each opposite side of the clear window for receiving a respective information strip;

said information strip comprising printed or typed information thereon and received in said first and second parallel channels with the information being viewable through said clear window, and opposite edges of said information stripe being concealed by said opaque stripes;

first and second parallel channels of the information strip holder comprising respective opaque bottom and top members providing the respective opaque stripes with the clear window in between and wherein a distance between the opaque stripes of the respective bottom and top members is less than a width of the strip so that a portion of the bottom and top opaque stripes covers a top and bottom edge of the respective strip; and the top and bottom members each having a mounting surface with a notch therein.

8. A system of claim 5 wherein a gap between an inside surface of the side channels and the information strip holder is less than a width of the information strip holder.

9. A system of claim 1 wherein a front surface of the top and bottom members lies in a same plane as said clear window, a plurality of the strip holders are provided, and top and bottom surfaces of said strip holders which abut against respective top or bottom surfaces of other strip holders are perpendicular to said plane.

10. A display system, comprising:

a display panel for mounting in a substantially vertical plane;

a plurality of information strip holders retained on said display panel;

said information strip holders each comprising a one piece unit formed of a top and bottom member with a clear window therebetween, said information strip holder having an open back behind the front window, and first and second opposing parallel channels are defined by a respective rear surface portion of said front window, a parallel back wall of respective said top and bottom members, and a flat wall of respective said top and bottom members perpendicular to said rear surface portion and back wall, said top and bottom members providing respective opaque stripes at opposite sides of the clear window for receiving a respective information strip, the opaque stripes covering opposite side edges of the information strip; and said information strip comprising information thereon and received in said first and second parallel channels with the information being viewable through said clear window.

* * * * *